US010753150B1

(12) United States Patent
Harkins

(10) Patent No.: US 10,753,150 B1
(45) Date of Patent: Aug. 25, 2020

(54) LADDER ATTACHMENT

(71) Applicant: Jeffrey Harkins, Birmingham, AL (US)

(72) Inventor: Jeffrey Harkins, Birmingham, AL (US)

( * ) Notice: Subject to any disclaimer, the term of this patent is extended or adjusted under 35 U.S.C. 154(b) by 0 days.

(21) Appl. No.: 16/503,536

(22) Filed: Jul. 4, 2019

Related U.S. Application Data

(63) Continuation-in-part of application No. 15/897,253, filed on Feb. 15, 2018, now abandoned.

(60) Provisional application No. 62/459,104, filed on Feb. 15, 2017.

(51) Int. Cl.
*E06C 7/00* (2006.01)
*E06C 7/14* (2006.01)

(52) U.S. Cl.
CPC ..... *E06C 7/143* (2013.01)

(58) Field of Classification Search
CPC ..... E06C 7/14; E06C 7/143; E06C 1/39
USPC ..... 248/210, 211; 182/107, 115, 116
See application file for complete search history.

(56) References Cited

U.S. PATENT DOCUMENTS

| | | | | |
|---|---|---|---|---|
| 5,031,723 | A * | 7/1991 | Hooten | E06C 1/38 182/120 |
| 9,732,558 | B2 * | 8/2017 | Ayala | E06C 7/143 |
| 2013/0140423 | A1 * | 6/2013 | Taylor | E06C 7/143 248/544 |
| 2013/0256481 | A1 * | 10/2013 | Saucier | E06C 7/143 248/210 |
| 2014/0263897 | A1 * | 9/2014 | Saucier | E06C 7/143 248/210 |

* cited by examiner

*Primary Examiner* — Steven M Marsh
(74) *Attorney, Agent, or Firm* — Wayne Edward Ramage; Baker Donelson

(57) ABSTRACT

A ladder attachment that secures a container to a ladder while keeping the ladder rungs free from obstruction, allowing the user to safely climb the ladder while the ladder attachment is in use. The ladder attachment comprises a rigid supporting arm and a container holder that is capable of securing a container to the ladder via the container's handle. In embodiments, the rigid supporting arm is configured to fit within the hollow rung of a ladder and rest gravitationally therein. Embodiments allow for easy installation and removal of the ladder attachment and may be inserted into either the left or right-hand side of the ladder.

15 Claims, 12 Drawing Sheets

LADDER ATTACHMENT

This application is a continuation-in-part application of U.S. patent application Ser. No. 15/897,253, filed Feb. 15, 2018, which claims benefit of and priority to U.S. Provisional App. No. 62/459,104, filed Feb. 15, 2017, both of which are incorporated herein by specific reference for all purposes.

FIELD OF INVENTION

This invention relates generally to a removable ladder attachment for holding a container, wherein the ladder attachment is configured to fit within the hollow rung of a ladder.

SUMMARY OF THE INVENTION

In various exemplary embodiments, the present invention comprises a ladder attachment with a rigid supporting arm and an associated mechanism for holding a container. The present invention also comprises a method of using the ladder attachment.

The supporting arm may be any length and width or radius suitable for use as described herein. Embodiments may comprise an elongated, rigid supporting arm that is between about 6 inches to about 6 feet in length, inclusive. In several exemplary embodiments, the supporting arm is about 15 inches to about 36 inches in length. In one embodiment, the supporting arm is about 4 feet in length.

In embodiments, the rigid supporting arm is configured to slide into a hollow rung of a ladder. When inserted into the hollow rung of a ladder, the arm rests gravitationally against the interior of the rung to support an associated container. The supporting arm may contain a coating that is designed to prevent the ladder attachment from sliding out of the ladder's hollow rung while the ladder attachment is in use. In several embodiments, the coating begins at one end of the arm and extends along a portion of the arm. The coating also may extend around the perimeter of the arm, or a portion thereof. Alternatively, the coating may extend across the entire length of the arm. The coating may be comprised of an anti-slip material. In non-limiting embodiments, the anti-slip material may be comprised of silicone, foam, plastic, or rubber.

The supporting arm may be cylindrical, rectilinear, or polygonal, or combinations there. For example, certain embodiments may comprise an arm that is triangular or square-shaped in cross-section. In other embodiments, the supporting arm is comprised of a tubular member in whole or in part.

The supporting arm comprises attachment means, such as an opening, gap, notch, or hole, at or proximate the end extending from the ladder (i.e., the end opposite the coating). The opening extends through at least a single face of the arm and is configured to allow a hook or other container-holding mechanism to pass through at least one face of the arm. In various embodiments, the supporting arm may comprise one or more additional openings, gaps, notches, or holes that are proximal to the first opening. Such proximal openings allow for the container-holding mechanism to be moved to a more medial location, if required. Embodiments with multiple openings may contain a plug or bolt that covers alternate openings when not in use. In tubular embodiments, an end cap is used to cover openings at one or both ends of the tube.

In several exemplary embodiments, the supporting arm is unitary and fixed in length. In alternative embodiments, the supporting arm may comprise multiple parts, or be adjustable in length (such as by telescoping components, or by moving a container-holding piece slidingly over the ladder insertion piece).

In various embodiments, a container-holding mechanism is attached to the elongated supporting arm of the ladder attachment. The container-holding mechanism may comprise a hook, strap, clamp, ring, clasp, buckle, chain, or any other mechanism or combination of mechanisms suitable for supporting a container by a handle of the container. In some embodiments, the container-holding mechanism comprises a hook with a spring-loaded gate, such as a carabiner.

Embodiments also comprise a method of securing a container to a ladder through the use of a ladder attachment. In embodiments, a container is secured to the ladder attachment via a hook, strap, loop, clamp, ring, clasp, buckle, chain, or other similar mechanism or combination of mechanisms suitable for supporting a container by a handle of the container. In certain embodiments, the container is secured to the ladder attachment via a hook with a spring-loaded gate, such as a carabiner. In embodiments, a supporting arm of the ladder attachment is inserted into the hollow rung of an aluminum ladder. So inserted, the arm rests gravitationally on the interior of the ladder rung such that the inserted portion of the arm becomes leveraged in and wedged within the hollow rung due to the gravitational pull exerted on the attached container. In this manner, the ladder attachment secures the container to the ladder while keeping the ladder rungs free from obstruction, allowing the user to safely climb the ladder while the ladder attachment is in use.

Embodiments allow for easy installation and removal of the ladder attachment and may be inserted into either the left or right-hand side of the ladder.

DETAILED DESCRIPTION OF EXEMPLARY EMBODIMENTS

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate manner.

Figure 1:
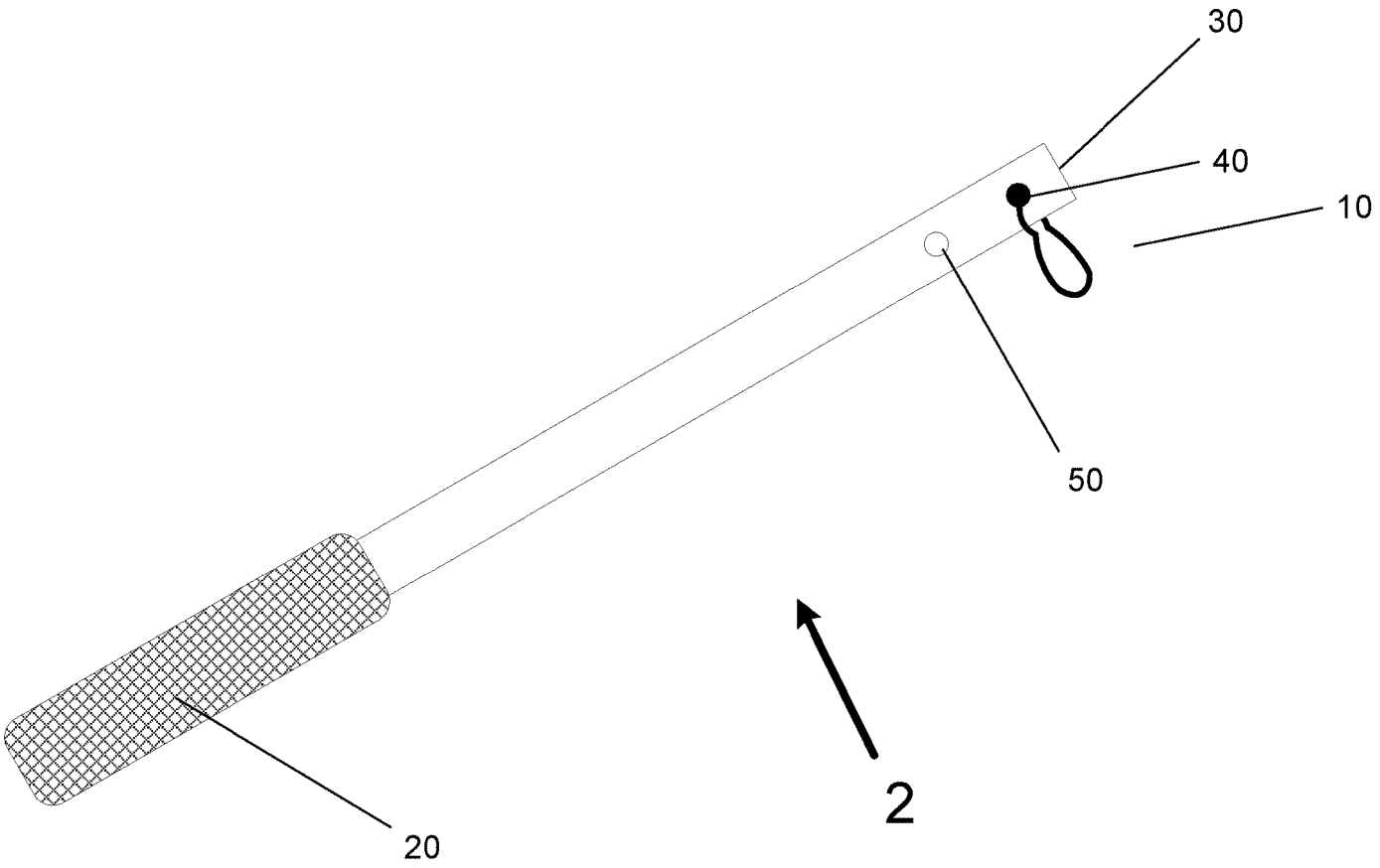
FIG. 1 shows an embodiment of the present invention.
Figure 2:
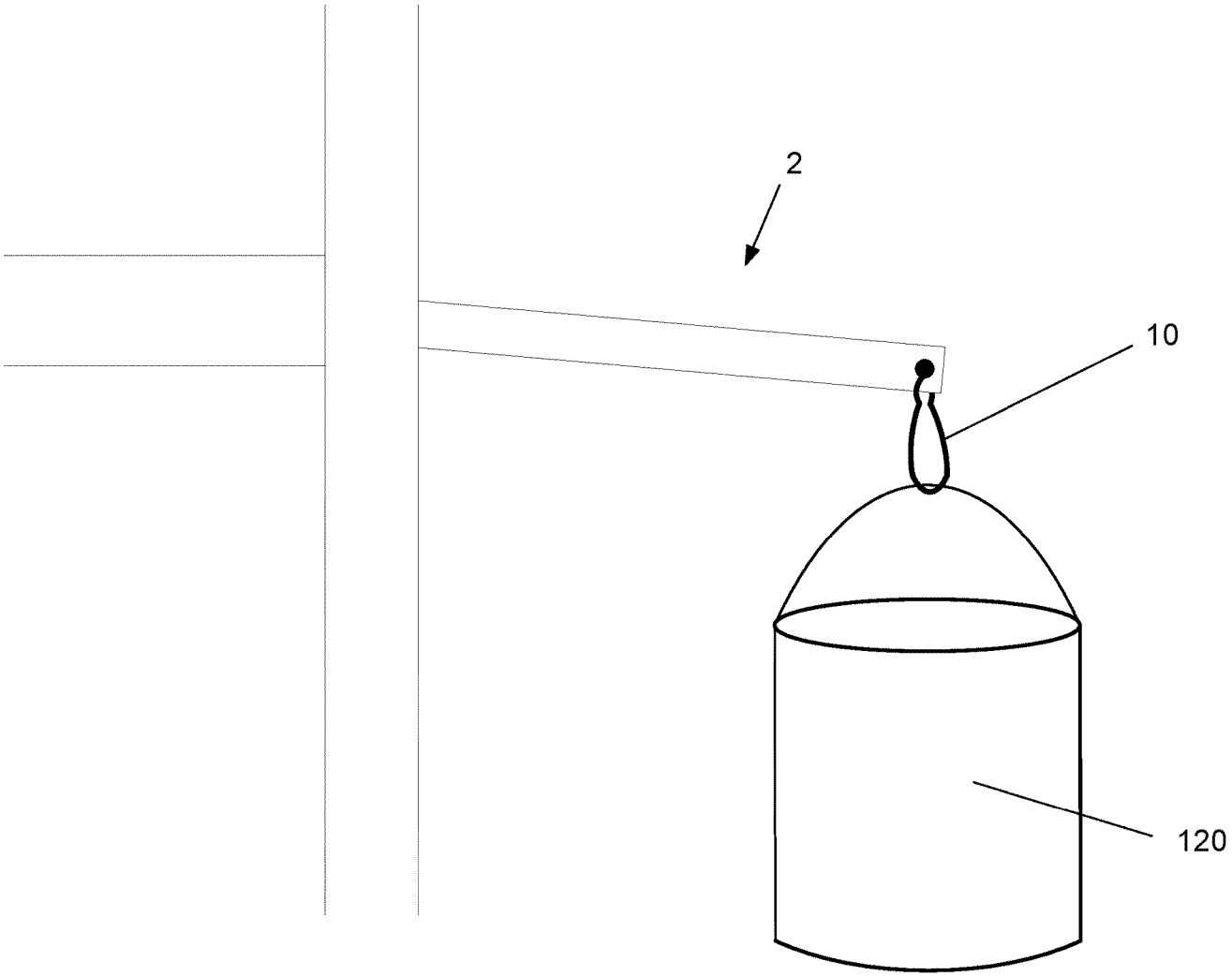
FIG. 2 shows an embodiment of the ladder attachment extending from the hollow rung of an aluminum ladder and supporting a container.
Figure 3:
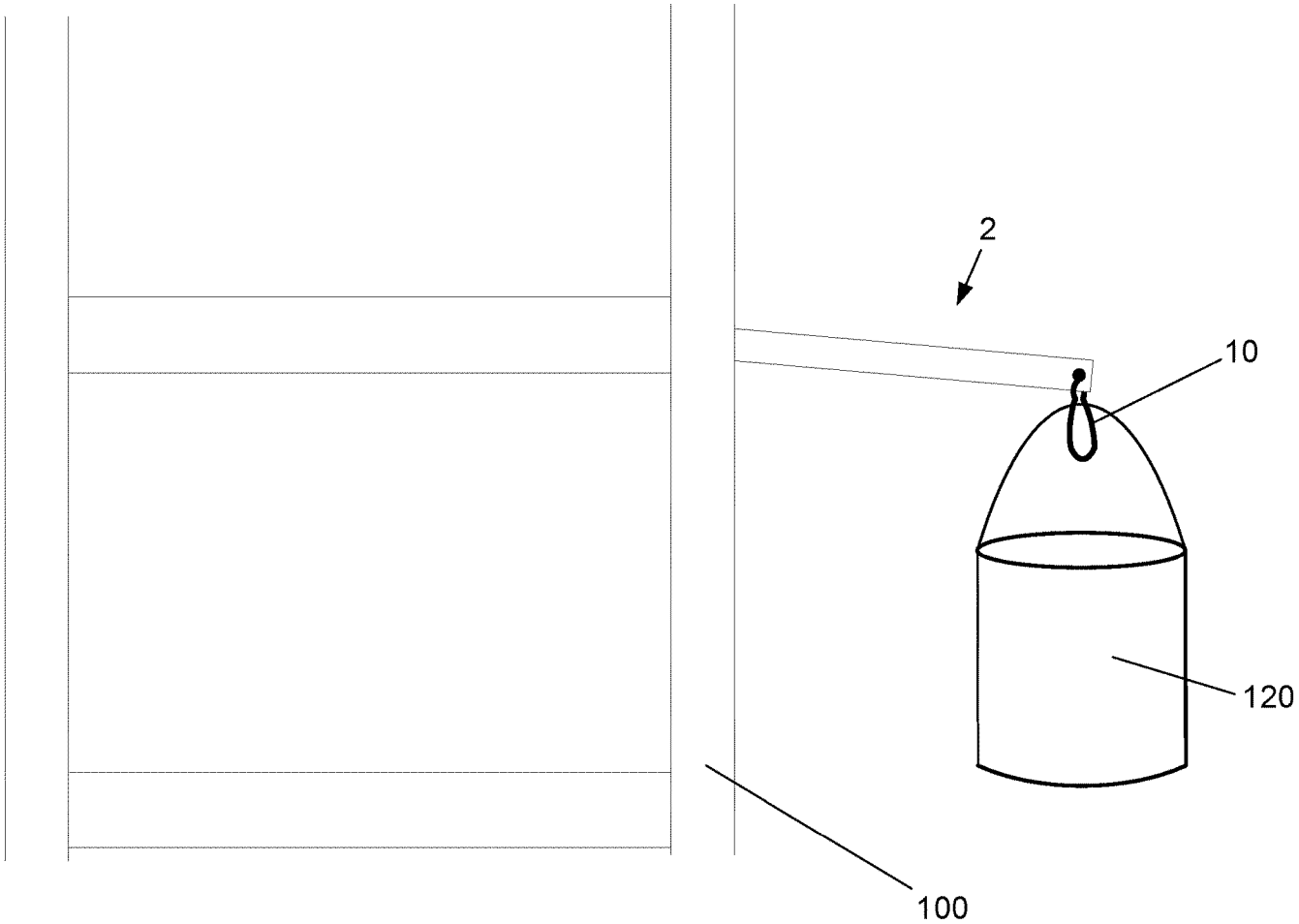
FIG. 3 shows a close up view of an embodiment of the ladder attachment extending from the hollow rung of an aluminum ladder and supporting a container.

In various exemplary embodiments, as described herein and seen in FIGS. 1-3, the ladder attachment comprises a supporting arm 2 with an insertion end 4 and a holding or exterior end 6 with a container-holding mechanism 10. The insertion end 4 of the supporting arm 2 is inserted into the hollow rung 102 of a ladder 100 (e.g., aluminum or metal ladder) while the opposing exterior end 6 supports a container 120 (such as a paint bucket) that is secured to the attachment via the holding mechanism 10.

As seen in FIGS. 2 and 3, the gravitation pull exerted on the attached container causes the supporting arm to become wedged within the interior of the ladder rung, thereby securing the ladder attachment and associated container to the ladder by leverage. The ladder rungs thus are free from obstruction, allowing the user to safely climb the ladder while the ladder attachment is in use.

In FIG. 2, the handle of an attached container is shown secured to the ladder attachment via the holding mechanism 10. In this particular embodiment the holding mechanism 10 is comprised of a carabiner-type hook with a spring-loaded gate. In this configuration, the handle of the container is clipped inside of the carabiner, which secures the container to the ladder attachment.

As seen in FIG. 1, the insertion end 4 of the supporting arm 2 comprises a handle and/or anti-slip coating or gripping mechanism 20 along a portion of the supporting arm. In several embodiments, the handle/coating begins at the insertion end of the arm and extends along a portion of the arm. The handle/coating also may extend entirely around the outer perimeter or circumference of the arm, or a portion thereof. Alternatively, in some embodiments, the coating may extend across the entire length of the arm, with a larger circumference handle at the insertion end. The hand/coating may be comprised of an anti-slip material. In non-limiting embodiments, the anti-slip material may be comprised of silicone, foam, plastic, or rubber. The handle also may comprise a series of ridges, or be otherwise patterned, to assist the user in gripping and holding the apparatus by the handle while carrying a loaded paint can or other container fastened to the other end.

Figure 4:
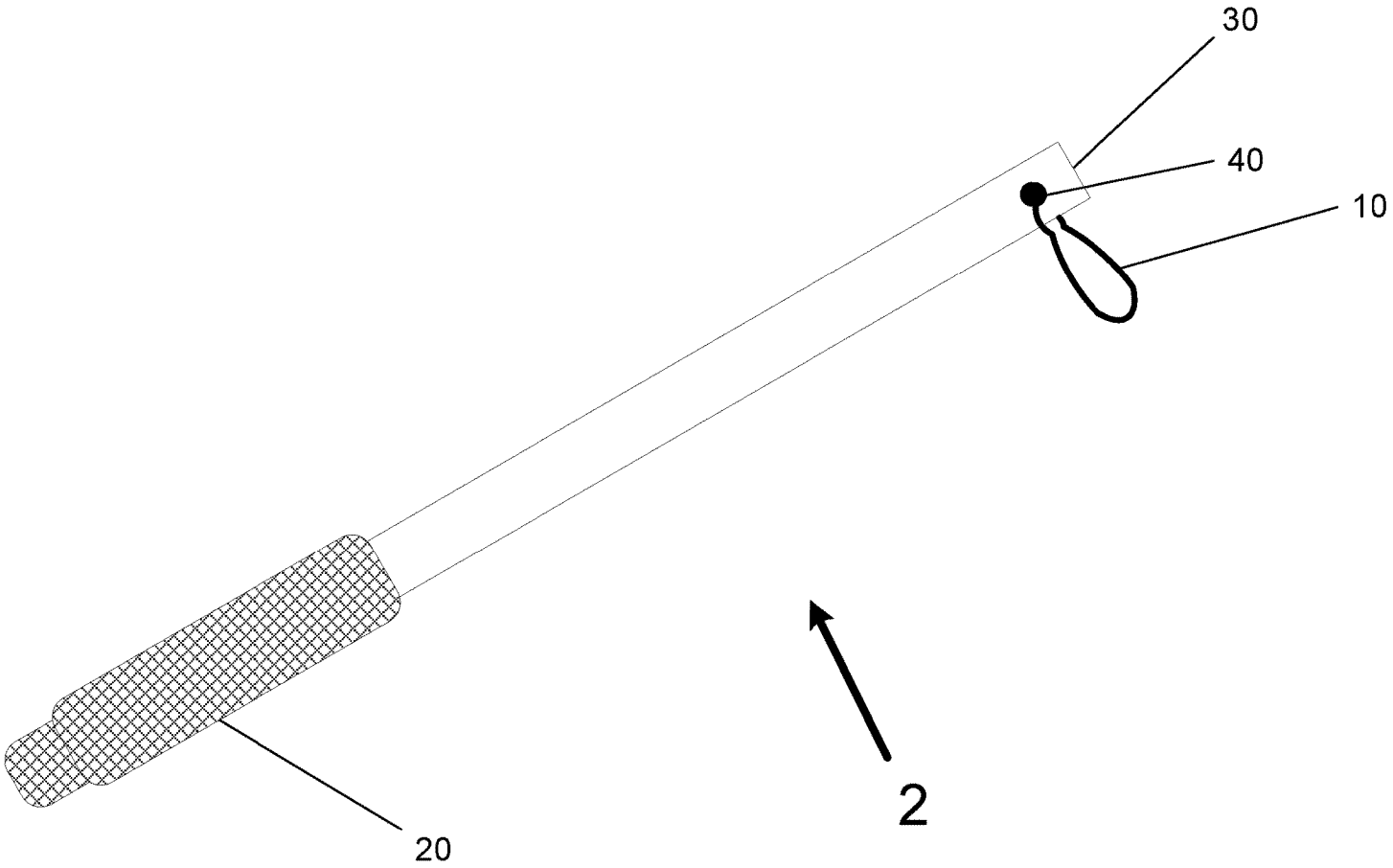
FIG. 4 shows another view of another embodiment of the ladder attachment.
Figure 5:
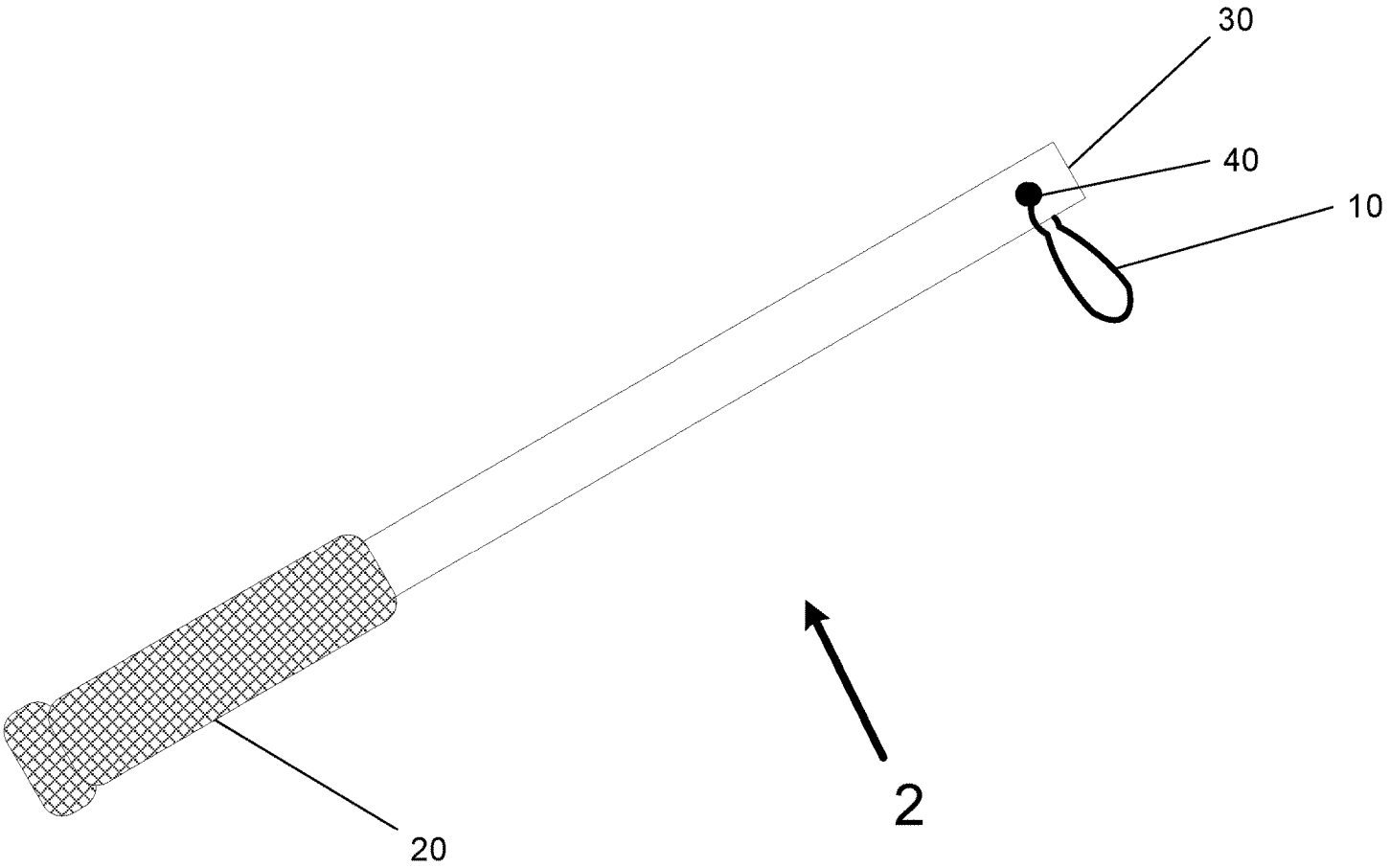
FIG. 5 shows another view of another embodiment of the present invention.

The supporting arm may be cylindrical, rectilinear, or polygonal, or combinations there. For example, certain embodiments may comprise an arm that is triangular or square-shaped in cross-section, as seen in FIGS. 2 and 3. In other embodiments, the supporting arm is comprised of a tubular member in whole or in part, as seen in FIGS. 4 and 5.

Figure 6:
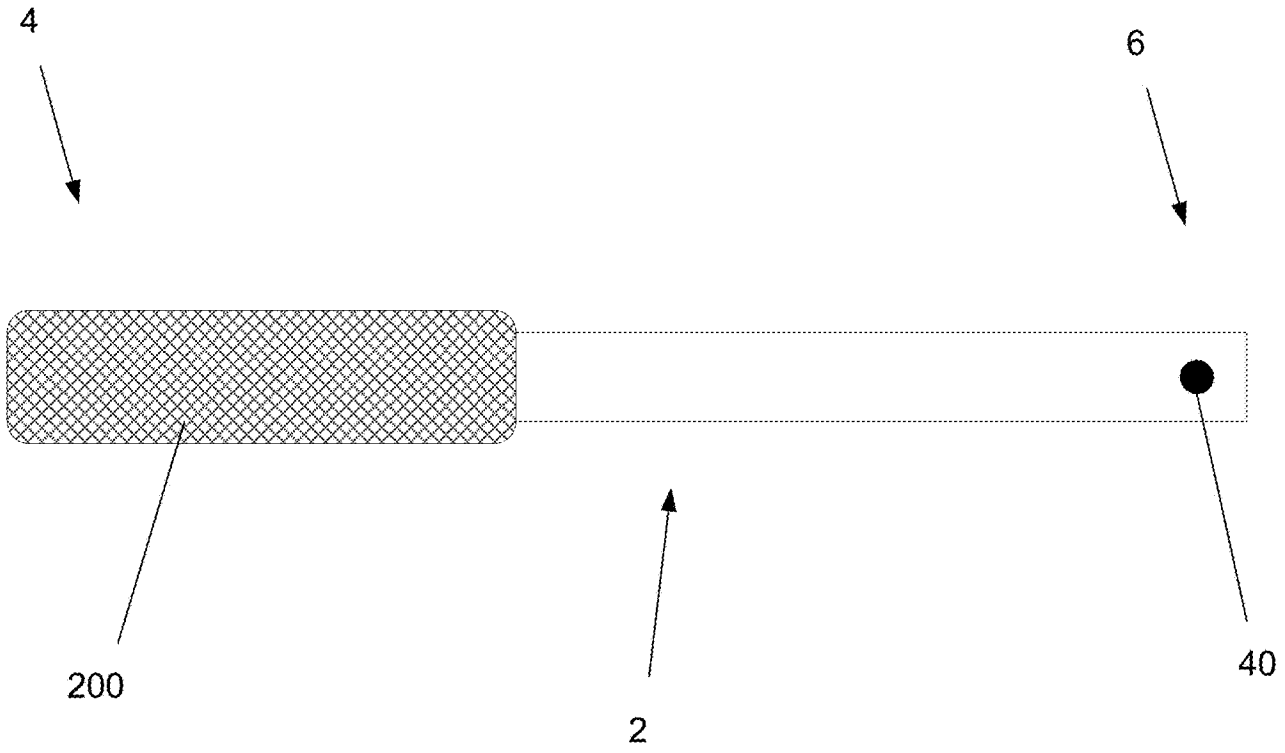
FIG. 6 shows a side view of the ladder attachment with container-holding mechanism or hook removed.
Figure 7:
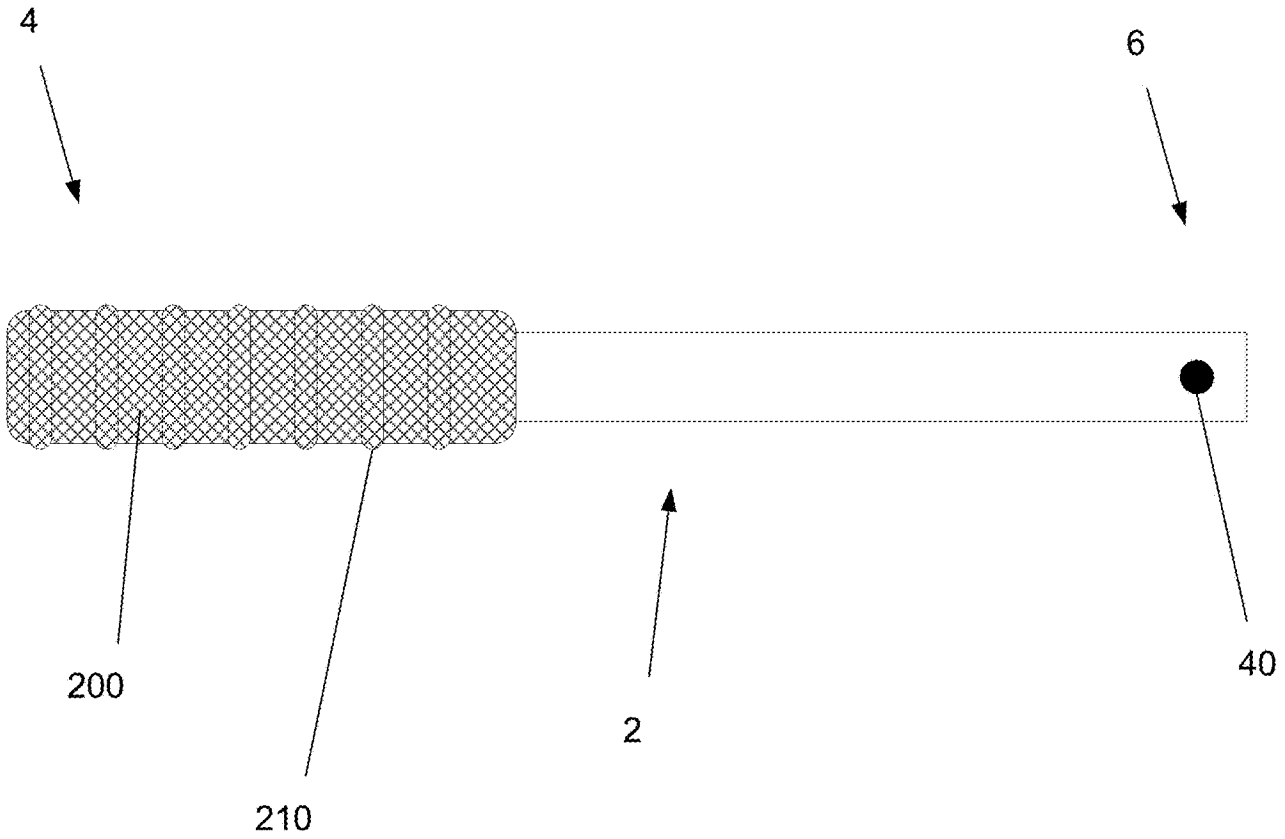
FIGS. 7-10 show side views of additional embodiments of the ladder attachment.
Figure 8:
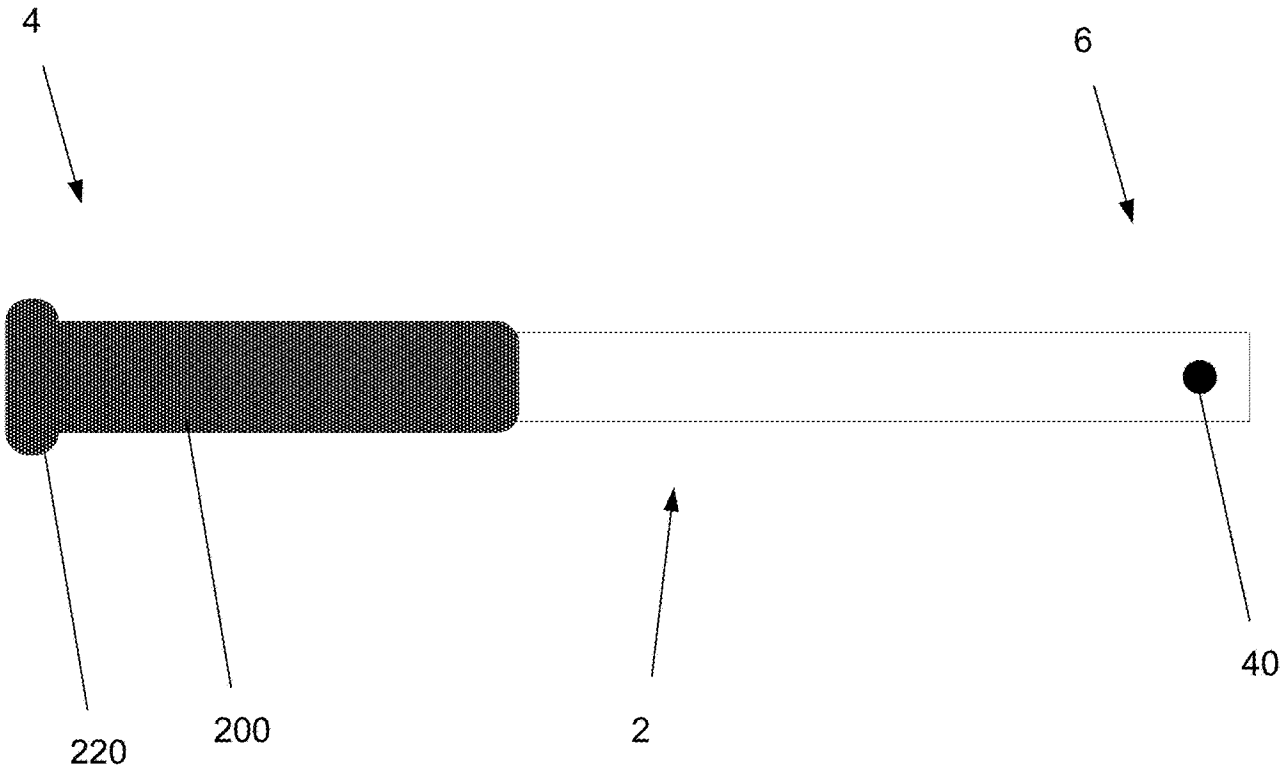
Figure 9:
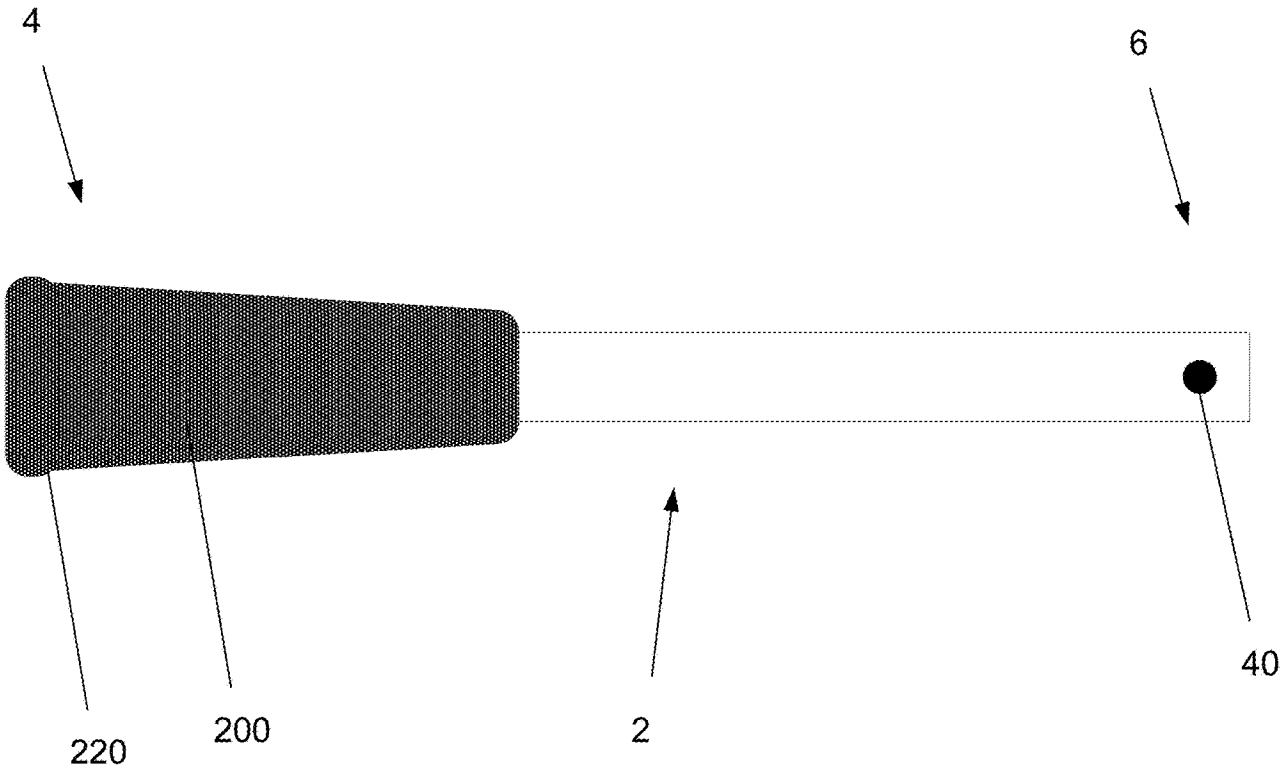
Figure 10:
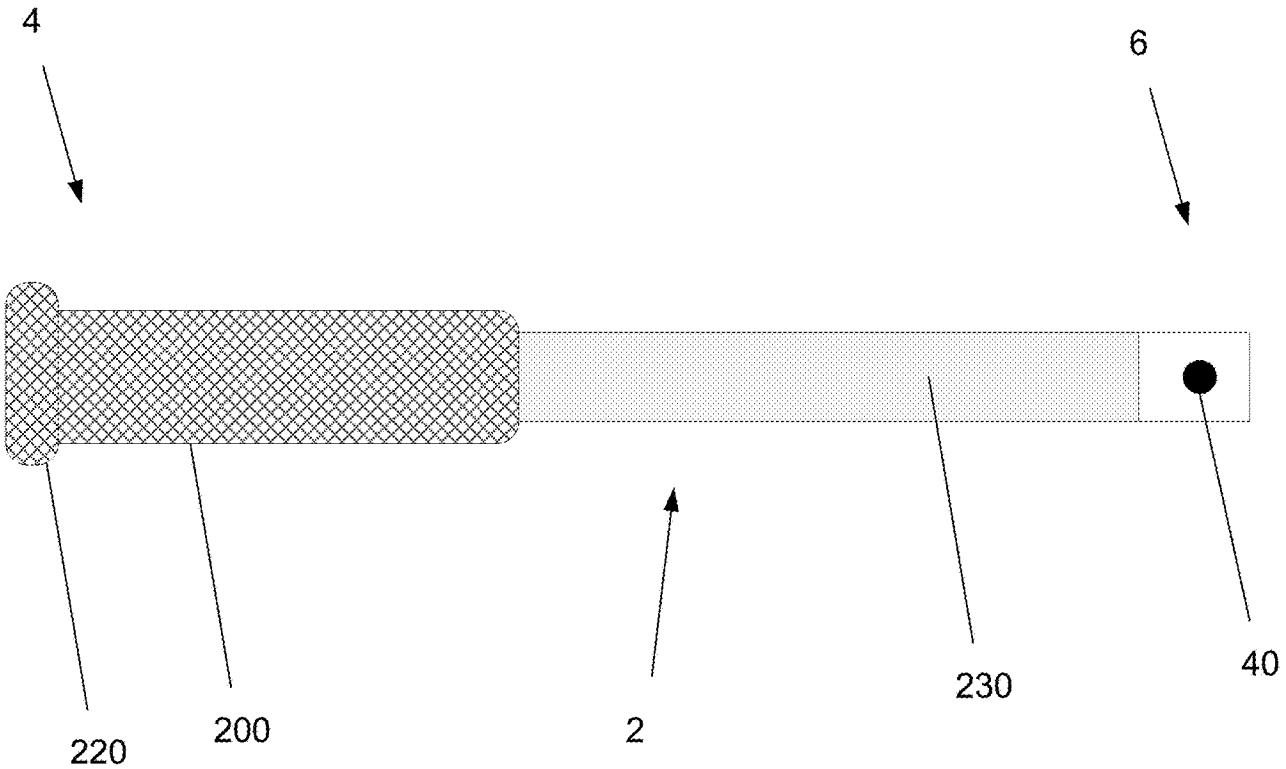

FIG. 6 shows a side view of an embodiment of the apparatus with a handle 200 covering the insertion end 4 of the arm 2, with a hole 40 at the exterior end 6 for attachment of the holding mechanism (not shown in this figure). In this embodiment, the handle has a greater circumference and diameter than the remaining portion of the arm 2; thus, the largest or widest diameter or width of the apparatus is found at or proximate to the insertion end. FIG. 7 shows the handle 200 with a series of ridges 210 to assist in gripping, as described above. FIG. 8 shows the handle 200 with an end cap or end piece 220. In this embodiment, the end cap or piece has a greater circumference and diameter than the rest of the handle or the remaining portion of the arm, and can serve as a reinforced point of contact with the interior of the hollow ladder rung when in use (as described below). An end cap or end piece may be used on a handle with or without ridges or patterning. FIG. 9 shows an alternative embodiment where the handle has a variable diameter and circumference (in this case, gradually increasing towards the insertion end). And FIG. 10 shows yet another alternative embodiment, with a portion 230 of the arm between the handle 200 and the exterior end being coated with a layer of anti-slip material.

Figure 11:
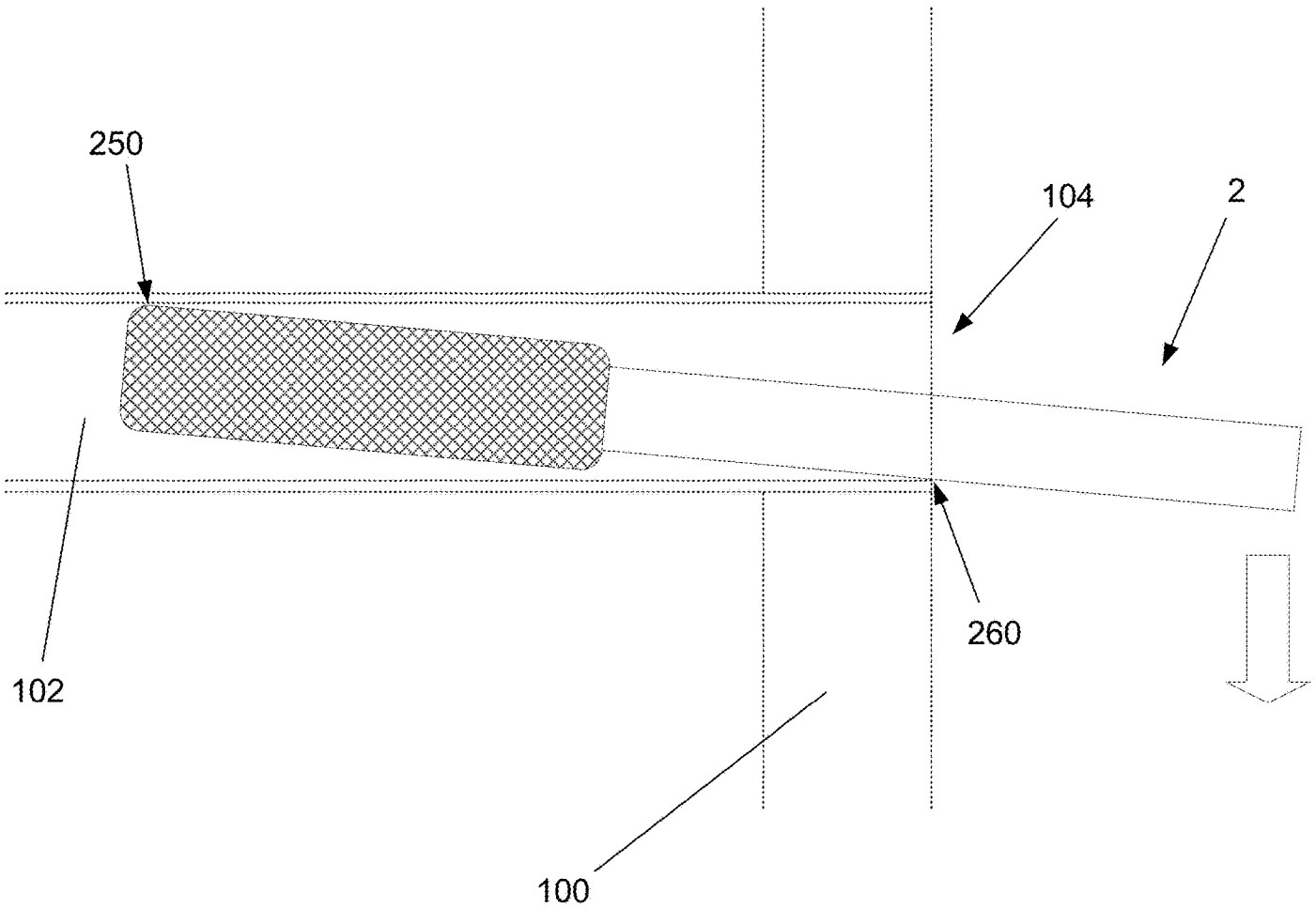
FIGS. 11-12 shows sides views of embodiments of the ladder attachment inserted into a hollow rung of a ladder.
Figure 12:
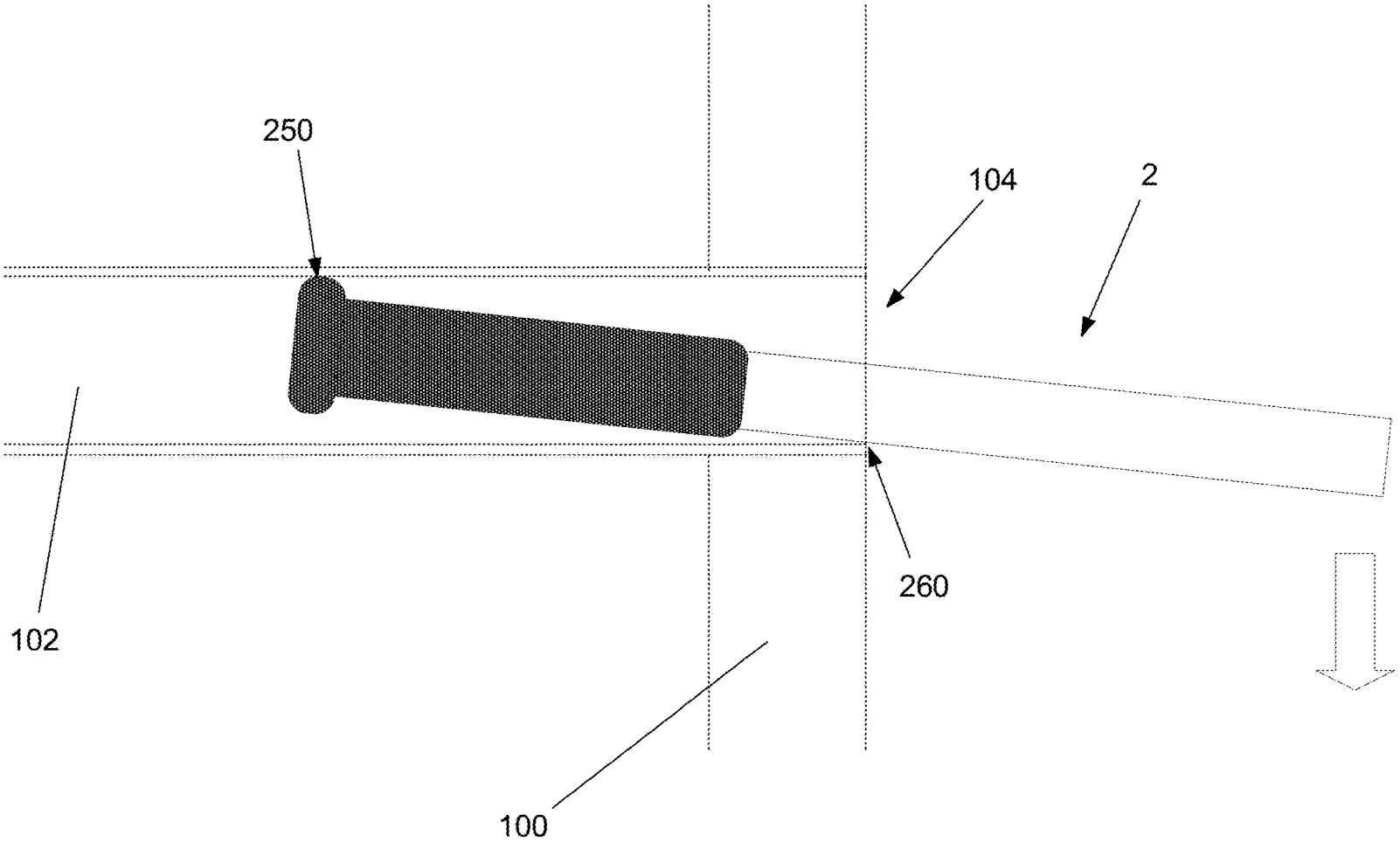

FIGS. 11 and 12 show examples of the present invention in use after being inserted into the hollow rung 102 of a ladder 100. In the embodiments shown, all portions of the apparatus inserted inside the hollow rung have a smaller diameter than the interior diameter of the rung. This allows for easy insertion (and removal) of the apparatus into the rung when the user has ascended to the desired height up the ladder. Insertion is easily accomplished with one hand with requiring the device to be forced in or pushed against resistance, as with prior art devices. The apparatus is inserted to a desired length, and the user then allows the exterior end to slightly drop, causing the top of the insertion end (such as the end-cap) to contact the top of the inside of the ladder rung at a first contact point 250, and the bottom of a medial portion of the arm to contact the bottom of the inside of the ladder run at or proximate the rung opening 104 at a second contact point 260. The weight of the paint can or container at the exterior end exerts downward force, creating a lever effect around the fulcrum created by the second contact point with commensurate upward force at the first contact point, thereby holding the apparatus securely in place. When in use, the apparatus only contacts the interior of the rung at two discrete points along the length of the inserted portion of the arm, and the resulting leverage effect keeps the apparatus in place.

It should be noted that the present invention thus allows the user to select a desired length of the apparatus to be inserted, thereby allowing variable insertion lengths for the same ladder rung. More specifically, the insertion length is not fixed or determined by the diameter of the rung opening, thereby allowing the user to determine how closely the paint can or container should be positioned next to the ladder. The amount of insertion changes the distance between the respective lever arms, i.e., the distance between the first and second points of contact, and the distance between the second point of contact and the attachment hole. As can be seen in the figures, the width or diameter of the insertion end at the first point of contact also can affect the angle of the arm respective to the axis of the rung (i.e., a greater width or diameter of the insert end at the first point of contact will reduce this angle, assuming the insertion length remains constant). Further, the points of contact are limited; at no point does a continuous circumferential section of the inserted arm contact all or substantially of the corresponding section of the rung interior. That is, no portion of the inserted arm contacts all or substantially all of the inner circumference of any portion of the interior of the hollow rung into which it is inserted. In several embodiments, no portion of the arm is greater in width, diameter or circumference than the inner width, diameter or circumference of the hollow rung.

Accordingly, for removal, the user simply pulls upward on or proximate to the exterior end of the arm, thereby releasing the leverage effect holding the apparatus in place. The apparatus can then be removed from the rung without substantial pulling force, such as that needed by prior art devices to dislodge the device from the ladder. The easy insertion and removal of the present invention thus provides a safety benefit to the user, as the use of substantial lateral forces for insertion or removal can unbalance the user while on the ladder, or cause the paint can or container to fall or move excessively.

The supporting arm comprises attachment means, such as an opening, gap, notch, or hole 40, at or proximate the exterior end extending from the ladder (i.e., the end opposite the coating). The opening 40 extends through at least a single face of the arm and is configured to allow a hook or other container-holding mechanism 10 to pass through at least one face of the arm.

In various embodiments, the supporting arm may comprise one or more additional openings, gaps, notches, or holes 50 that are proximal to the first opening. Such proximal openings allow for the container-holding mechanism to be moved to a more medial location, if required. Embodiments with multiple openings may contain a plug or bolt that covers alternate openings when not in use. In several embodiments, an end cap 30 be used to cover all or part of the openings at one or both ends of the tube.

In several exemplary embodiments, the supporting arm is unitary and fixed in length. In alternative embodiments, the supporting arm may comprise multiple parts, or be adjustable in length (such as by telescoping components, or by moving a container-holding piece slidingly over the ladder insertion piece).

The present invention may be made of any suitable material, including, but not limited to, plastic, metal, steel, aluminum, wood, or combinations thereof. It also may be provided in a variety of colors or textures, or combinations thereof. In certain embodiments, the supporting arm is comprised of a steel or aluminum tubular member.

In one exemplary embodiment, the arm is around 11 inches long, which allows for the apparatus and the attached paint can or container to be easily carried by a user up and down the ladder. Depending on the item being carried, the user can hold the apparatus at either end, and thus can hold the handle of a full paint can and the apparatus at the same time for added security. The arm is rigid, and thus can hold more weight securely. The apparatus of this length is sufficiently long to provide adequate leverage during use, while also being short enough to fit inside most toolboxes, boxes or bags. Further, the apparatus of this length also can be stored inside most containers while the arm remains attached to the container handle.

Embodiments also comprise a method of securing a container to a ladder through the use of a ladder attachment. In embodiments, a container is secured to the ladder attachment via a hook, strap, loop, clamp, ring, clasp, buckle, chain, or other similar mechanism or combination of mechanisms suitable for supporting a container by a handle of the container. In certain embodiments, the container is secured to the ladder attachment via a hook with a spring-loaded gate, such as a carabiner. In embodiments, a supporting arm of the ladder attachment is inserted into the hollow rung of an aluminum ladder. So inserted, the arm rests gravitationally on the interior of the ladder rung such that the inserted portion of the arm becomes wedged via leverage at two points of contact within the hollow rung due to the gravitational pull exerted on the attached container. In this manner, the ladder attachment secures the container to the ladder while keeping the ladder rungs free from obstruction, allowing the user to safely climb the ladder while the ladder attachment is in use. Embodiments allow for easy installation and removal of the ladder attachment and may be inserted into either the left or right-hand side of the ladder.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

The invention claimed is:

1. A ladder attachment, comprising:

an elongated supporting arm with two ends, an insertion end and a holding end; and holding means on the holding end for securely holding a container;

wherein said insertion end is adapted to be inserted inside a hollow rung of a ladder, the hollow rung having an opening and an interior surface;

wherein the elongated supporting arm comprises a handle beginning at the insertion end and extending therefrom along a portion of the supporting arm;

wherein the elongated supporting arm has greatest width or diameter at the insertion end;

further wherein the insertion end contacts the interior surface of the hollow rung only at a first contact point at or proximate the greatest width or diameter at the insertion end and a second contact point at or proximate to the opening of the hollow rung, and is configured to secure the supporting arm inside the hollow rung of the ladder by leverage when said container is held on the container holding means.

2. The ladder attachment of claim 1, further comprising a coating covering at least a portion of the insertion end.

3. The ladder attachment of claim 1, wherein said holding means comprises a carabiner or hook attached to a hole or opening in the holding end.

4. The ladder attachment of claim 1, wherein the first contact point and second contact are separated by a length of the elongated supporting arm sufficient to secure the arm inside the hollow rung of the ladder by leverage.

5. The ladder attachment of claim 1, wherein the insertion end is circular or elliptical in cross-section.

6. The ladder attachment of claim 1, wherein the insertion end is rectilinear or polygonal in cross-section.

7. The ladder attachment of claim 1, wherein no portion of the elongated supporting arm contacts all or substantially all of the interior surface of a section of the hollow rung.

8. The ladder attachment of claim 1, wherein no portion of the elongated supporting arm is greater in width, diameter or circumference than the interior surface of the hollow rung.

9. The ladder attachment of claim 1, further comprising an end cap at the insertion end, wherein the elongated supporting arm has greatest width or diameter at the end cap.

10. The ladder attachment of claim 9, wherein the first contact point is at the end cap.

11. The ladder attachment of claim 1, further wherein the supporting arm is configured to be released by application of an upward pulling force on the exterior end of the arm.

12. The ladder attachment of claim 1, further wherein the supporting arm is unitary.

13. The ladder attachment of claim 1, further wherein the supporting arm comprises multiple parts.

14. The ladder attachment of claim 1, further wherein the supporting arm is fixed in length.

15. The ladder attachment of claim 1, wherein the greatest width or diameter of the insertion end of the elongated supporting arm is the same before and after being secured inside the hollow rung of the ladder.

* * * * *